US007758703B2

(12) United States Patent
Lee et al.

(10) Patent No.: US 7,758,703 B2
(45) Date of Patent: Jul. 20, 2010

(54) DISHWASHER AND METHOD OF SUPPLYING WATER TO THE DISHWASHER

(75) Inventors: Tae Hee Lee, Boocheon-si (KR); Sang Heon Yoon, Gwangmyung-si (KR)

(73) Assignee: LG Electronics Inc. (KR)

( * ) Notice: Subject to any disclaimer, the term of this patent is extended or adjusted under 35 U.S.C. 154(b) by 663 days.

(21) Appl. No.: 11/604,391

(22) Filed: Nov. 27, 2006

(65) Prior Publication Data

US 2007/0131257 A1 Jun. 14, 2007

(30) Foreign Application Priority Data

Nov. 28, 2005 (KR) ..... 10-2005-0114249
Nov. 28, 2005 (KR) ..... 10-2005-0114252

(51) Int. Cl.
*B08B 3/00* (2006.01)

(52) U.S. Cl. ..... 134/56 D; 134/57 D; 134/58 D; 261/58

(58) Field of Classification Search ..... None
See application file for complete search history.

(56) References Cited

U.S. PATENT DOCUMENTS

2004/0244432 A1* 12/2004 Kim et al. ..... 68/5 C
2005/0241683 A1 11/2005 Jeong

FOREIGN PATENT DOCUMENTS

KR 2005105722 A * 11/2005
WO WO 2004058035 A1 * 7/2004

OTHER PUBLICATIONS

Stickel, Martin, WO 2004/058035A1, Jul. 2004, English machine translation.*

* cited by examiner

*Primary Examiner*—Michael Barr
*Assistant Examiner*—Jason Y Ko
(74) *Attorney, Agent, or Firm*—McKenna Long & Aldridge LLP

(57) ABSTRACT

Provided are a dishwasher and a method of supplying water in the dishwasher. The dishwasher includes a tub defining a washing chamber; a sump retaining washing water that is supplied to the tub; a steam generating device mounted on a side of the tub and having a steam chamber provided with a heater heating washing water; a first passage through which the washing water is supplied to the steam chamber; a second passage supplying the steam generated by the steam generating device from the steam chamber to the tub; and a third passage that supplies the washing water remained in the steam chamber to the sump after the steam is generated.

17 Claims, 5 Drawing Sheets

DISHWASHER AND METHOD OF SUPPLYING WATER TO THE DISHWASHER

This application claims the benefit of Korean Patent Application Nos. 10-2005-0114249, filed on Nov. 28, 2005, and 10-2005-0114252, filed on Nov. 28, 2005, both of which are incorporated by reference for all purposes as if fully set forth herein.

BACKGROUND OF THE INVENTION

1. Field of the Invention

The present invention relates to a dishwasher and, more particularly, to a dishwasher that uses steam washing depending on how dirty the dishes to be washed are and that uses high temperature water remaining in a steam generating device for washing after the steam washing is performed.

2. Discussion of the Related Art

Generally, a dishwasher is a machine that washes and dries dishes by spraying washing water with high pressure in a tub so that the sprayed water contacts the dishes to remove foreign objects such as food waste from the surface of the dishes. The removed food wastes are filtered off by a filter to reuse the washing water. Detergents are dissolved in the washing water so that the food wastes can be effectively removed from the dishes.

Meanwhile, a variety of schemes for improving the washing efficiency of the dishwasher have been proposed.

For example, the washing efficiency may be improved by heating the washing water and thus more effectively dissolving the detergent in the washing water. By spraying high temperature water, the hardened food wastes may be more effectively removed from the dishes.

A pre-washing cycle may be added to the inherent cycles of the dishwasher so that the food waste swells, thereby improving the reliability of the washing.

However, in spite of these schemes, there is a limit to increasing the washing efficiency of the dishwasher. Particularly, it is more difficult to effectively wash the dishes when the food waste adhered to the dishes is hardened.

Accordingly, a device for swelling the hardened food wastes, such as a steam generating device and other relevant components may be included in the dishwasher to swell the food wastes. However, when mildly dirty dishes are washed using steam washing or high temperature washing, the energy consumption unnecessarily increases.

Current dishwashers have steam generating devices that do not allow easy draining of water remaining in the steam chamber because the water container is disposed under the dishwasher. When the remaining water is left for a long time, it may allow the growth of bacteria or mold resulting in bad odors.

SUMMARY OF THE INVENTION

Accordingly, the present invention is directed to a dishwasher and method of supplying water to the dishwasher that substantially obviates one or more problems due to limitations and disadvantages of the related art.

An advantage of the present invention is to provide a dishwasher, in which no washing water remains in a steam generating device after the steam washing is complete. That is, the remaining high temperature washing water in the steam generating device is used in the next washing cycle after the steam washing is completed, thereby reducing the energy consumption.

Another advantage of the present invention is to provide a dishwasher that can selectively perform the steam washing according to the degree that the dishes are dirty. That is, the washing water for the dishes that are mildly dirty is directly supplied to the sump.

Additional features and advantages of the invention will be set forth in the description which follows, and in part will be apparent from the description, or may be learned from practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a dishwasher includes: a tub defining a washing chamber; a sump retaining washing water that is supplied to the tub; a steam generating device mounted on a side of the tub and having a steam chamber provided with a heater heating washing water; a first passage through which the washing water is supplied to the steam chamber; a second passage supplying the steam generated by the steam generating device from the steam chamber to the tub; and a third passage that supplies the washing water remained in the steam chamber to the sump after the steam is generated.

In another aspect of the present invention, a method of supplying water of a dishwasher, includes: providing washing water from a water feed source to a steam generating device trough a first passage; providing steam generated by the steam generating device to a tub through a second passage in a steam washing cycle; and removing washing water remaining in the steam generating device to a sump through a third passage after the steam washing cycle is completed.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiment(s) of the invention and together with the description serve to explain the principle of the invention.

In the drawings.

DETAILED DESCRIPTION OF THE ILLUSTRATED EMBODIMENTS

Reference will now be made in detail to an embodiment of the present invention, examples that are illustrated in the accompanying drawings.

The invention may, however, be embodied in many different forms and should not be construed as being limited to the embodiments set forth herein; rather, these embodiments are provided so that this disclosure will be thorough and complete, and will fully convey the concept of the invention to those skilled in the art.

Figure 1:
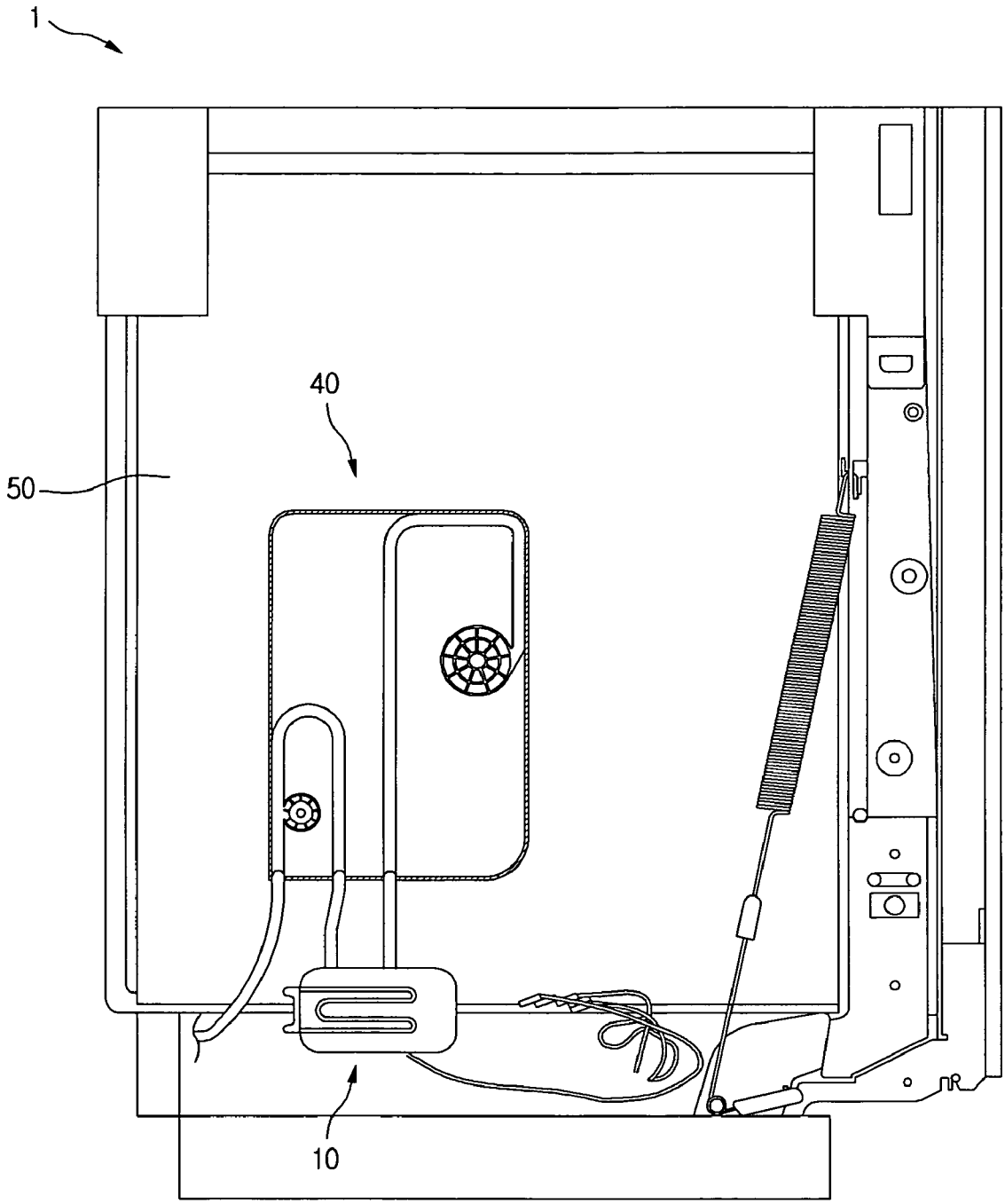
FIG. 1 is a sectional view of a dishwasher having a steam generating device according to an embodiment of the present invention.

FIG. 1 is a sectional view of a dishwasher having a steam generating device that is integrally formed with a air brake assembly.

Referring to FIG. 1, a dishwasher 1 includes a tub 50 defining a washing chamber, a air brake assembly 40 that is formed on an outer surface of the tub 50 to control the amount of water supplied, and a steam generating device 10 that is mounted under the air brake assembly 40 to supply steam into the tub 50.

The dishwasher 1 further includes a sump (60 of FIG. 3) in which the washing water is retained. The sump 60 may be mounted at the bottom center of the tub 50.

The air brake assembly 40 is disposed on a side surface of the dishwasher 1 to perform a variety functions such as air brake control, a pressure control in the tub, and an external air suction control.

Figure 2:
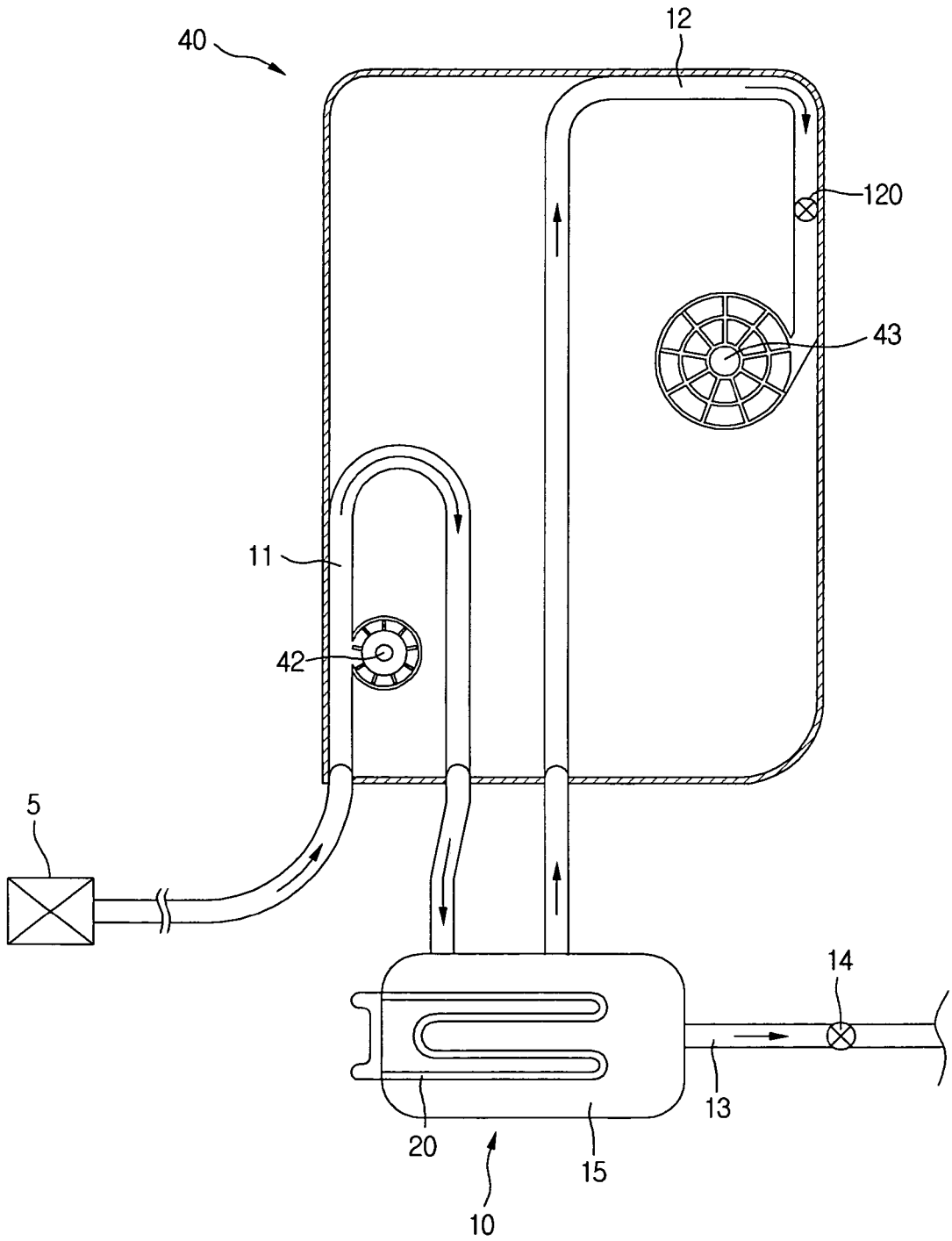
FIG. 2 is a schematic view illustrating a flow path for the washing water during a steam washing cycle of the dishwasher according to an embodiment of the present invention.

FIG. 2 is a schematic view of a flow path for the washing water in the dishwasher.

Referring to FIG. 2, a first passage 11 is connected between a water feed source 5 and a steam generating device 10 to supply washing water to the steam generating device 10.

The first passage 11 is partly formed in the air brake assembly 40.

A flow meter 42 is located at an extreme end of the first passage 11 disposed in the water supply assembly 40. The flow meter 42 rotates due to the washing water passing to measure an amount of the water supplied.

The steam generating device 10 is mounted under the water supply assembly 40 at the side of the tub 50. The steam generating device 10 includes a steam chamber 15 having a heater 20.

The steam chamber 15 may be formed of plastic through an injection molding process so as to stably store the high temperature washing water and the steam.

After the washing water reaches a predetermined level, the steam generating device 10 generates the steam by heating the washing water using the heater 20 and supplies the steam to the tub 50 through a second passage 12.

The second passage 12 is connected to a tub communication hole 43. The second passage 12 functions as a connection pipe through which the steam generated in the steam generation device 10 enters into the tub 50.

A steam valve 120 is mounted downstream in the second passage 12. The steam valve 120 is opened only when the steam is supplied to the steam chamber 15 to supply the steam into the tub 50.

Meanwhile, the steam valve 120 is closed when the steam washing is not performed. Therefore, during the normal cycles such as the washing cycle and rinsing cycle, the dirty washing water cannot be directed through the second passage 12.

The steam valve 120 prevents the dirty washing water and foreign objects from entering and remaining in the second passage 12, thereby preventing the growth of microorganisms that may cause a foul odor and thus keeping the dishwasher clean.

A third passage 13 is a connection passage through which the remaining high temperature washing water in the steam generating device 10 is supplied to the sump (60 of FIG. 3) after the steam supply cycle is completed. One end of the third passage 13 is connected to the steam chamber 15 and the other end is connected to the sump 60.

A sump valve 14 is further installed in the third passage 13. The sump valve 14 is closed when the washing water is supplied into the steam chamber 15, when the washing water in the steam chamber 15 is being heated, or when the steam is generated during the steam washing. On the contrary, the sump valve 14 is opened when the washing water is supplied to the sump 60.

After the steam washing is complete, the high temperature washing water remaining in the steam chamber 15 is directed into the sump 60 through the third passage 13 so that the high temperature washing water may be reused.

Figure 3:
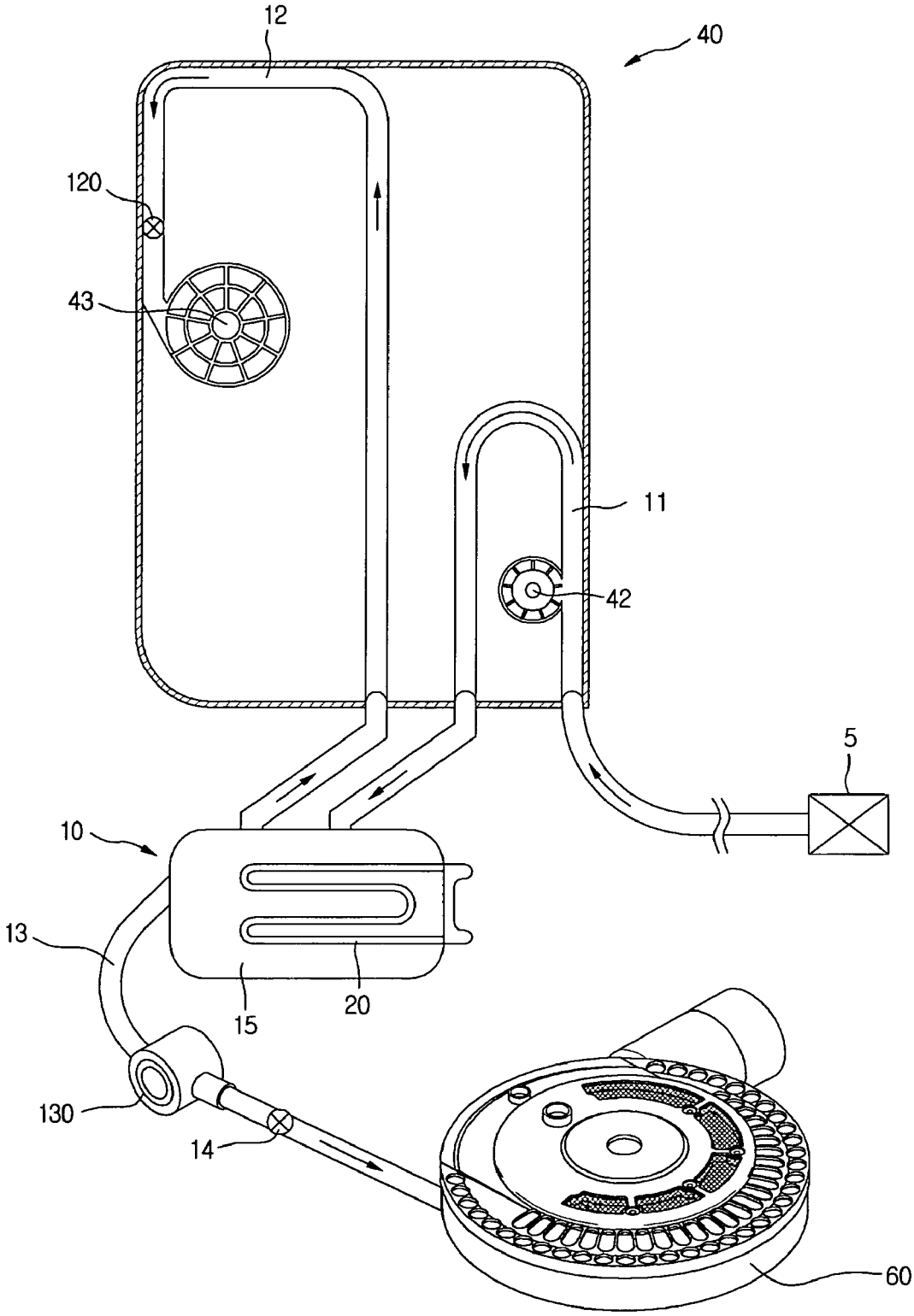
FIG. 3 is a schematic view illustrating a connection structure of a air brake assembly, a steam generating device, and a sump according to an embodiment of the present invention.

FIG. 3 is a schematic view illustrating a connection structure of the water supply assembly 40, the steam generating device 10, and the sump 60 in the dishwasher according to an embodiment of the present invention.

Referring to FIG. 3, the first passage 11 is connected to the water feed source 5 and the steam generating unit 10. The second passage 12 is connected to the steam generating device 10 and the tub communication hole 43. The third passage 13 is connected to the steam generating device 10 and the sump 60.

The first and second passages 11, 12 are partly formed in the water supply assembly 40. A steam valve 120 that controls when steam is supplied is installed on the second passage 12, and a sump valve 14 that controls when the washing water is supplied to the sump is installed in the third passage 13.

A pump 130 is installed on the third passage 13 to remove the water that remains in the steam generating device 10 after the steam washing cycle is completed. The pump 130 may be installed anywhere in the third passage 13. Preferably, the pump 130 is installed upstream of the sump valve 14. That is, the pump 130 is installed near the steam chamber 15.

When the pump 130 is driven, no water remains in the steam chamber 15, thereby preventing the malfunctioning of the dish washer and the contamination of the dishwasher even when the dishwasher is not used for a long time.

Figure 4:
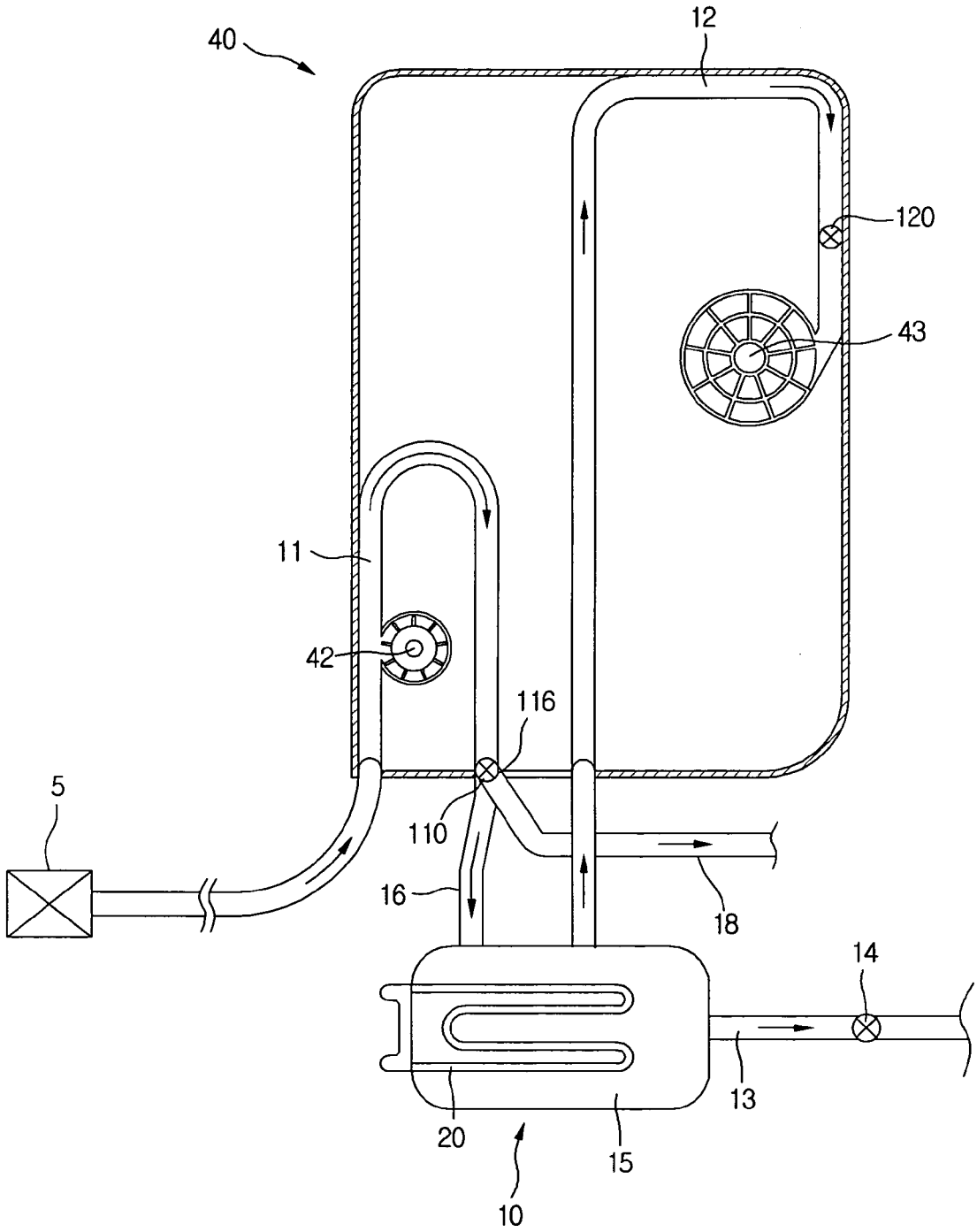
FIG. 4 is a schematic view of a flow path for the washing water during a specific washing cycle of a dishwasher according to another embodiment of the present invention.

FIG. 4 is a schematic view of a water flow path for the washing water during a specific washing cycle of the dishwasher according to another embodiment of the present invention.

This embodiment may be used during a normal washing cycle where no steam washing occurs because the dishes are mildly dirty.

Referring to FIG. 4, the washing water supplied from the water feed source 5 is directed into the steam generating device 10 through the first passage 11.

A fourth passage 18 that is directly connected to the sump (60 of FIG. 5) branches off from the first passage 11 formed at the extreme end of the water supply assembly 40. A control valve 110 for selectively directing the input wash water to one of the first and fourth passages 11 and 18 is installed at a junction 116 of the first and fourth passages 11 and 18.

A lower passage 16 of the first passage 11 is outside the water supply assembly 40 and is connected to the steam generating device 10.

In the washing or rinsing cycle or any other cycle than the steam cycle, the control valve 110 directs the washing water to the sump 60 through the fourth passage 18 while not allowing the washing water to be directed to the lower passage 16 of the first passage.

Therefore, this cycle of this embodiment is used when the dishes are mildly dirty. Therefore, the washing can be quickly completed, and thus, energy consumption can be reduced.

Furthermore, in a high temperature washing cycle and a steam washing cycle, the control valve directs the washing water to the steam generating device 10 through the lower passage 16 of the first passage 11 while not allowing the washing water to be directed to the fourth passage 18. Here, when only the high temperature washing is required, the high temperature water whose temperature is adjusted by adjusting the intensity of the heater 20 is supplied to the sump 60 through the third passage 13. This cycle can be used when the dishes are very dirty.

Meanwhile, the sump valve 14 that is opened when the washing water is supplied to the sump 60 from the steam generating device 10 is installed in the third passage 13. The sump valve 14 is closed when the washing water is supplied into the steam chamber 15, when the washing water retained in the steam chamber 15 is being heated, or the steam is generated during the steam washing. On the contrary, the sump valve 14 is opened when the washing water is supplied to the sump 60.

In addition, during the generation of the steam, the sump valve 14 is closed and the washing water supplied from the first passage 11 to the steam generating device 10 is heated by the heater 20 to generate the steam. The generated steam is supplied to the tub 50 through the second passage 12.

The steam valve 120 is further installed downstream in the second passage 12. The steam valve 120 is opened when the steam is supplied from the steam chamber 15 to the tub 50. In the normal washing cycle, the steam valve 120 is closed.

Accordingly, in the normal washing cycle such as the washing cycle and rinsing cycle, the dirty washing water cannot enter into the second passage 12.

The steam valve 120 prevents that the dirty washing water and foreign objects from entering and remaining in the second passage 12, thereby preventing the growth of microorganisms that may cause foul odors and thus keeping the dishwasher clean.

After steam generation is complete, the sump valve 14 is opened and the steam valve 120 is closed to supply high temperature washing water remaining in the steam chamber 15 into the sump 60. The high temperature washing water supplied to the sump 60 is reused for the washing cycle together with other washing water.

The washing water may be supplied into the sump 60 via the steam generating device 10. Alternatively, only a portion of the washing water may be supplied to the sump 60 via the steam generating device 10 and the rest may be directly supplied to the sump 60.

Figure 5:
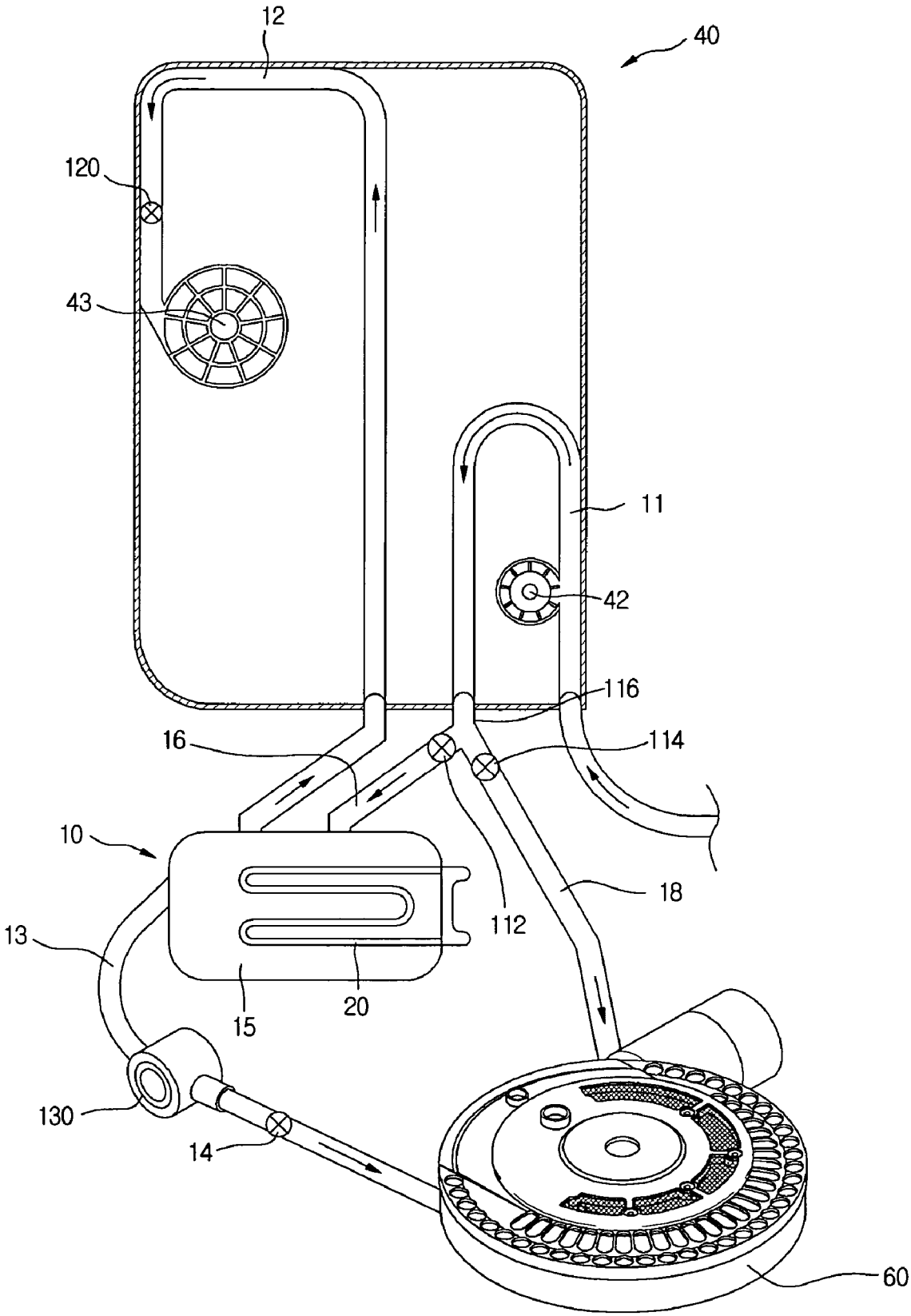
FIG. 5 is a schematic view illustrating a connection structure of a air brake assembly, a steam generating device, and a sump in a dishwasher according to another embodiment of the present invention.

FIG. 5 is a schematic view illustrating a connection structure of the water supply assembly, the steam generating device, and the sump in the dishwasher according to an embodiment of the present invention.

Referring to FIG. 5, a fourth passage 18 that is directly connected to the sump 60 and the lower passage 16 of the first passage 11 connected to the steam generating device 10 connect to a branched portion 116. The branched portion 116 is connected to the first passage 11. Valves 112 and 114 that direct water flow when the steam washing and the normal washing are preformed are installed in the lower passage 16 of the first passage 11 and/or downstream of the branched portion 116 of the fourth passage 18.

In the normal washing cycle, the valve 112 is closed and the valve 114 is opened. Therefore, the washing water supplied through the first passage 11 is supplied to the sump 60 through the fourth passage 18.

In the high temperature washing cycle and steam washing cycle, the valve 112 is opened and the valve 114 is closed. The washing water supplied through the first passage 11 is supplied to the steam chamber 15 through the lower passage 16 of the first passage 11.

With the above-described structure, one of the normal washing cycle and the steam washing cycle is selected based upon how dirty the dishes are, thereby reducing the energy consumption.

A pump 130 is further included on the third passage 13 to remove the water that remains in the steam generating device 10 after the steam washing cycle is complete. The pump 130 may be installed anywhere along the third passage 13. Preferably, the pump 130 is installed upstream of the sump valve 14, that is, the pump 130 is installed near the steam chamber 15.

When the pump 130 is driven, no water remains in the steam chamber 15, thereby preventing the malfunctioning of the dish washer and the contamination of the dishwasher even when the dishwasher is not used for a long time.

The water supply method of the dishwasher will now be described with reference to FIGS. 2 through 5.

When the washing water is supplied from the water feed source 5 to the sump 60, the washing water is first directed from the water feed source 5 to the steam generating device 10 through the first passage 11. When steam washing is performed, the steam generated from the steam generating device 10 is directed to the tub 50 through the second passage 12. After the steam washing is completed, the high temperature steam generated in the steam generating unit 10 is directed to the sump 60 through the third passage 13. After the high temperature washing water remaining in the steam chamber 15 is directed to the sump 60, the pump 130 provided upstream of the third passage 13 directs the remained washing water to the sump 60.

In the normal washing cycle and the rinsing cycle, the washing water is directed to the sump 60 through the fourth passage 18 that branches off from the first passage 11 and directly connects to the sump 60.

That is, the water flow passage can be selected by the control valve 110 formed on the first passage 11 and/or the fourth passage 18 according to the selected cycle, i.e., the normal washing cycle or the rinsing cycle.

According to the above-described dishwasher and the method of supplying the water in the dishwasher, because the washing water for the dishes that are mildly dirty is directly supplied to the sump 60 through the fourth passage 18 without passing via the steam generating device 10, the energy consumption may be reduced and the washing cycle can be quickly completed.

After the steam washing is completed, because the high temperature water remaining in the steam chamber 15 is supplied to the sump 60 by the pump 130, the contamination of the remaining water and the malfunctioning of the dishwasher can be prevented.

Furthermore, the steam valve 120 installed in the second passage 12, prevents the dirty washing water or foreign objects from entering the tub 50 to the second passage 12.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A dishwasher comprising:

a tub defining a washing chamber;

a sump retaining washing water that is supplied to the tub;

a steam generating device having a steam chamber provided with a heater configured to heat washing water;

a first passage through which the washing water is supplied to the steam chamber;

a second passage supplying the steam generated by the steam generating device from the steam chamber to the tub; and a third passage that supplies the washing water remaining in the steam chamber to the sump after the steam is generated, wherein one end of the third passage is directly connected to the steam generating device and the other end is directly connected to the sump.

2. The dishwasher according to claim 1, wherein portions of the first and second passages are within an air brake assembly.

3. The dishwasher according to claim 1, further comprising a steam valve installed in the second passage, the steam valve being open when the steam is supplied.

4. The dishwasher according to claim 1, further comprising a sump valve installed in the third passage, the sump valve being open when the washing water is supplied to the sump.

5. The dishwasher according to claim 1, further comprising a pump on the third passage to remove washing water remaining in the steam chamber.

6. The dishwasher according to claim 1, wherein a fourth passage branches off from the first passage and directly connects to the sump.

7. The dishwasher according to claim 6, further comprising a control valve installed at a junction of the first and fourth passages to select the flow direction of the washing water.

8. The dishwasher according to claim 6, further comprising a valve installed in the first passage downstream from a junction of the first passage and the fourth passage.

9. The dishwasher according to claim 6, further comprising a sump valve installed in the third passage, the sump valve being open when the washing water is supplied to the sump.

10. The dishwasher according to claim 6, further comprising a pump on the third passage to remove the washing water remaining in the steam chamber.

11. The dishwasher according to claim 6, further comprising a steam valve in the second passage, the steam valve being open when the steam is supplied.

12. A dishwasher comprising:

a tub defining a washing chamber;

a sump retaining washing water that is supplied to the tub;

a steam generating device having a steam chamber provided with a heater configured to heat washing water to generate steam;

a first passage through which the washing water is supplied to the steam chamber;

a second passage supplying the steam generated by the steam generating device from the steam chamber to the tub; and a third passage that supplies the heated washing water remaining in the steam chamber directly to the sump after a steam supply cycle is completed.

13. The dishwasher according to claim 12, further comprising a sump valve installed in the third passage, the sump valve being open when the washing water is supplied to the sump.

14. The dishwasher according to claim 12, wherein a fourth passage branches off from the first passage and directly connects to the sump.

15. A dishwasher comprising:

a tub defining a washing chamber;

a sump retaining washing water that is supplied to the tub;

a steam generating device having a steam chamber provided with a heater configured to heat washing water to generate steam;

a first passage through which the washing water is supplied to the steam chamber;

a second passage supplying the steam generated by the steam generating device from the steam chamber to the tub, wherein at least some portions of the first passage and the second passage are integrally formed in a water supply assembly; and a third passage that supplies the washing water remaining in the steam chamber directly to the sump after the steam is generated.

16. The dishwasher according to claim 15, wherein the water supply assembly includes a tub communication hole to supply the steam generated by the steam generating device from the steam chamber to the tub.

17. The dishwasher according to claim 15, further comprising a sump valve installed in the third passage, the sump valve being open when the washing water is supplied to the sump.

* * * * *